United States Patent [19]

Grandy

[11] Patent Number: 4,615,191

[45] Date of Patent: Oct. 7, 1986

[54] BARREL COMBINATION LOCK

[75] Inventor: Kenneth N. Grandy, So. Milwaukee, Wis.

[73] Assignee: Master Lock Company, Milwaukee, Wis.

[21] Appl. No.: 700,244

[22] Filed: Feb. 11, 1985

[51] Int. Cl.[4] ..... E05B 37/02

[52] U.S. Cl. ..... 70/26; 70/317; 403/328; 403/349

[58] Field of Search ..... 70/316, 317, 386, 315, 70/312, 25, 26, 30, 443–445, 318, 319; 403/349, 348, 328

[56] References Cited

U.S. PATENT DOCUMENTS

| | | | |
|---|---|---|---|
| 334,636 | 1/1886 | Bromley | 70/316 |
| 1,410,033 | 3/1922 | Pass | 70/316 |
| 1,706,994 | 3/1929 | Beck | 70/312 |
| 1,741,969 | 12/1929 | Bellows | 403/348 X |
| 1,898,947 | 2/1933 | Frey | 70/312 |
| 2,526,998 | 10/1950 | Davis | 403/349 X |
| 3,592,027 | 7/1971 | Wako | 70/25 |
| 4,354,365 | 10/1982 | Mayer et al. | 70/316 X |

FOREIGN PATENT DOCUMENTS

| | | | |
|---|---|---|---|
| 19971 | of 1904 | United Kingdom | 403/328 |

*Primary Examiner*—Gary L. Smith
*Assistant Examiner*—Lloyd A. Gall
*Attorney, Agent, or Firm*—Pennie & Edmonds

[57] ABSTRACT

A barrel and cable type combination lock having clutches with changeable combination wheels mounted thereon. A grooved cable shackle is held in a lock position by balls engageable with the shackle grooves and the clutches and wheels. A barrel removable end cap functions to hold the combination wheels in place when the lock is operable, and upon the removal of the cap the combination wheels can be moved to create a new combination. Cap detent means cooperate with the cable shackle to hold the cap in position when the lock is in lock position and permits the cap's removal when the lock is unlocked.

3 Claims, 4 Drawing Figures

3
3
10
11
12
13
14a
14b
14c
14d
17
18
19
21
22
23
24
26
27
28a
28d
29
31
32
33
34
34a
34b
36
36a
36b
38c
38d
39a
39d
41
42
45
46
48

BARREL COMBINATION LOCK

BACKGROUND OF THE INVENTION

Barrel combination locks which allow the user to change the combination without the use of tools have been proposed (see U.S. Pat. Nos. 4,354,365 and 4,445,348). The permutation wheels of the locks of these patents carry outer rings which can be set by the user for selecting a combination of the user's choosing.

Prior proposals have not provided a simple and reliable way of holding the outer rings in place during normal lock operation and permitting the ready disassembly of the outer rings to permit changes in the combination.

SUMMARY OF THE INVENTION

Broadly, the present invention comprises a barreltype combination lock having a cable sleeve and a lock body into which the sleeve is engaged to effect locking. The combination can be readily changed by sliding the permutation wheels off the clutches and replacing them in different radial positions. The permutation wheels are held on the lock body by a removable end cap. The end cap is removable only when the sleeve is withdrawn because the presence of the sleeve in the lock body prevents operation of a release latch arrangement.

DESCRIPTION OF THE PREFERRED EMBODIMENT

Figures 1, 2, 4:
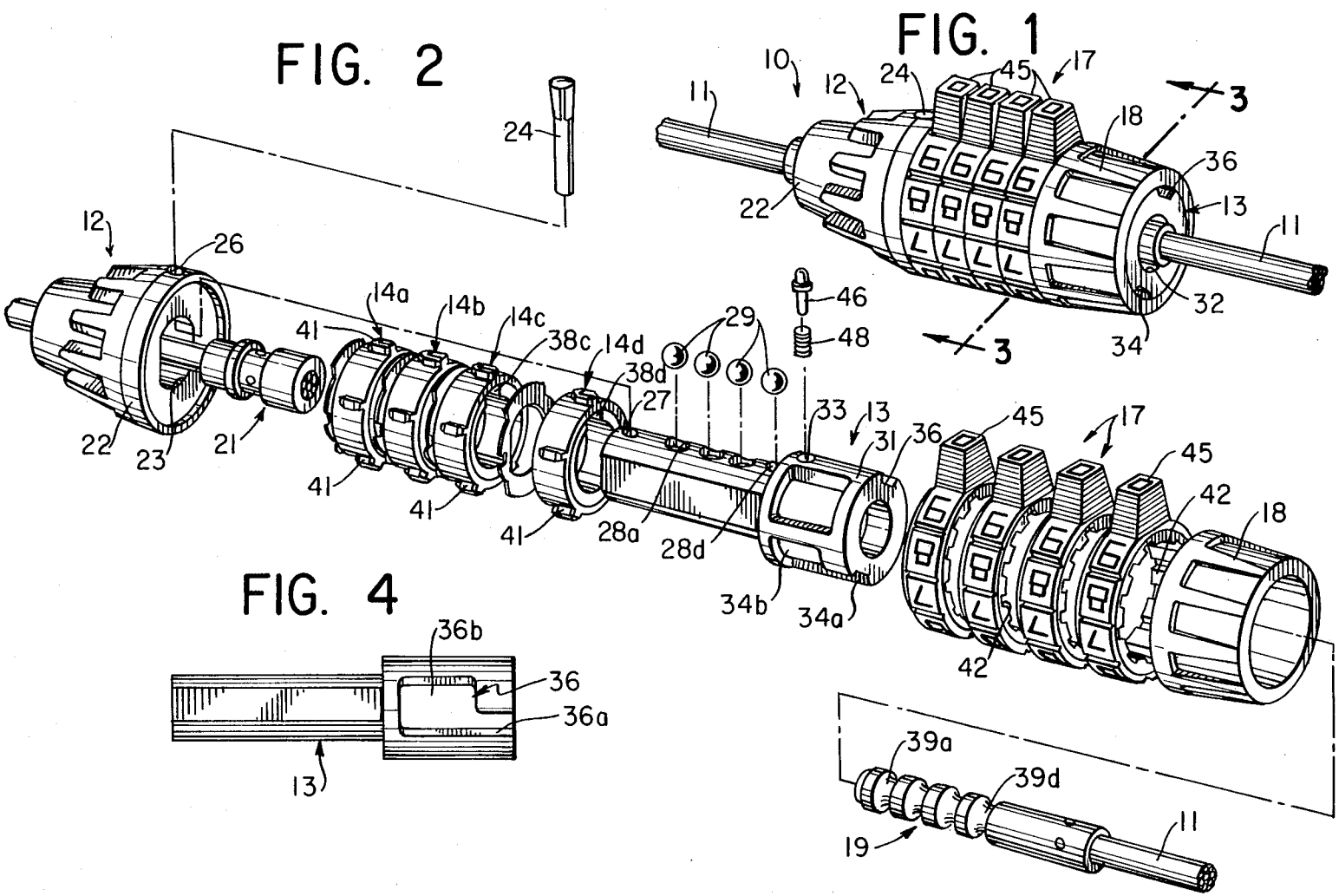
FIG. 1 is a perspective view of the barrel combination lock as locked.
FIG. 2 is an exploded perspective view of the lock as disassembled.
FIG. 4 is a partial plan view of the shaft body including its grooved collar.

In the figures, barrel lock 10 includes flexible cable 11, fixed end cap 12, lock shaft body 13, clutches 14*a*, 14*b*, 14*c* and 14*d*, combination wheels 17, removable end cap 18 and shackle 19.

Cable sleeve 21 is swaged to cable 11. Fixed end cap 12 includes cap body 22 internal and shaped cavity 23. Cable sleeve 21 prevents cable 11 from being withdrawn from shaped cavity 23. Shaft body 13 is pinned to cap 12 by passing lock pin 24 through cap hole 26 and shaft body hole 27.

Shaft body 13 includes an internal cavity 13*a* (not shown) for receiving shackle 19 and four (4) aligned cylindrical well holes 28*a*, 28*b*, 28*c*, and 28*d* communicating with the shaft cavity for receiving four (4) locking balls 29. Shaft body 13 also has a shaft collar 31 which in turn includes collar cavity 32, pin-receiving hole 33 and locking grooves 34, 36. Clutches 14*a*, 14*b*, 14*c* and 14*d* each carry locking ball recesses 38*a*, 38*b* (not shown), 38*c* and 38*d* (shown) into which locking balls 29 move when the clutches 14*a*, 14*b*, 14*c* and 14*d* are in their unlocked positions and the shackle is pulled toward its removal. Shackle 19 includes four (4) lock ball grooves 39*a*, 39*b*, 39*c* and 39*d* which are shaped so that when the shackle is pulled in an effort to withdraw it from shaft body 13, balls 29 will be cammed up through holes 28 into clutch recesses 38. Clutches 14 also carry projections 41 which are engageable with the plurality of combination wheel internal recesses 42 on each wheel 17. Combination wheels 17 also carry thumb pieces 45 to assist rotating and translating wheels 17.

In its assembled and unlocked condition, lock 10 clutches are positioned on shaft body 13 and wheels 17 are positioned on and around the clutches 14 whereby rotation of a wheel 17 causes its mating clutch 14 to rotate. In its assembled condition, shaft collar 31 prevents removal of clutches 14 and removable end cap 18 prevents removal of wheels 17.

Figure 3:
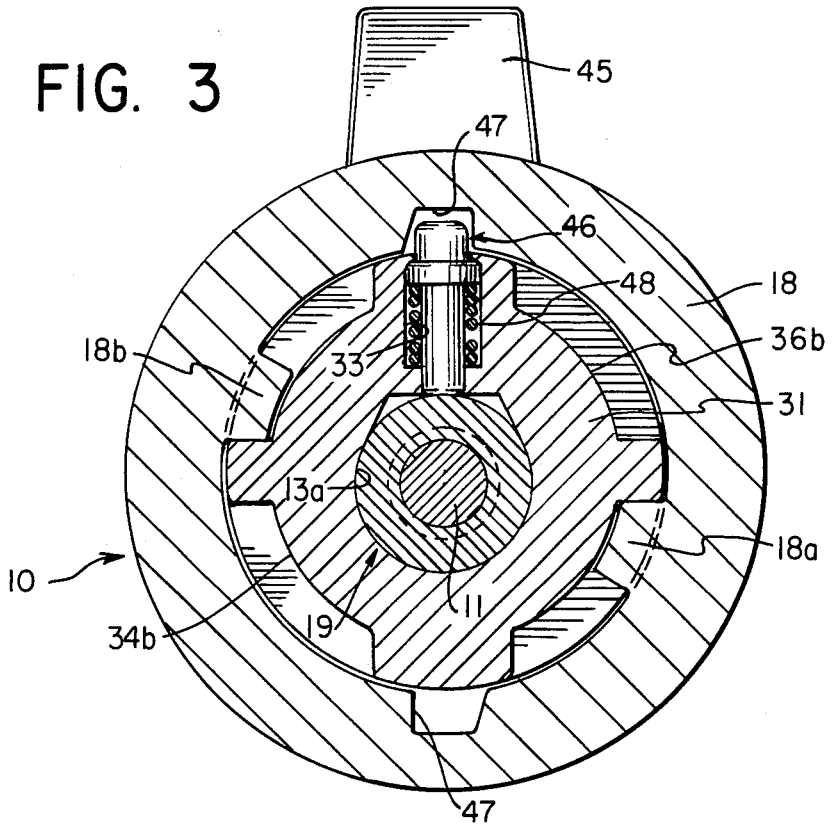
FIG. 3 is a sectional view taken along line 3—3 of FIG. 1.

With particular reference to FIGS. 3 and 4, end cap 18 has short internal tangs 18*a*, 18*b* which align with L-shaped sleeve grooves 34, 36 during assembly of cap 18 onto sleeve 31. Each groove 34, 36 includes longitudinal portion 34*a*, 36*a* and cross portion 34*b*, 36*b*. Once cap 18 is axially moved onto sleeve 31, cap 18 is then turned as tangs 18*a*, 18*b* move in cross portion grooves 34*b*, 36*b* until pin 46 as biased by spring 48 moves upwardly into recess 47 in the interior of cap 18. Cap 18 is removed by turning it in a reverse direction which initial turning cams pin 46 downwardly releasing the cap 18 for further turning and subsequent removal. When cap 18 is in its installed position and shackle 19 in its locked position, detent pin 46 cannot be moved downwardly by placing a torque on cap 18 because pin 46 abuts against the shackle 19 and cannot therefore move downwardly out of cap recess 47 (FIG. 3).

To place lock 10 in its locked position, wheels are dialed to the unlock combination (note pin 24 marks the zero reference position), shackle 19 is inserted through end cap cavity 18*c*, collar cavity 32 and into shaft body cavity 13*a*. As shackle 19 enters shaft body cavity 13*a* balls 29 are cammed upwardly through well holes 28 and into clutch recesses 38. Upon completion of entry of shackle 19 into cavity 13*a*, the balls 29 will descend into shackle grooves 39. One or more of the wheels 17 is then dialed to a lock position. In the lock position, removable end cap 18 cannot be removed because detent pin 46 is positioned in cap lock groove 47 and the end of the detent pin 46 rests against cable sleeve 19 preventing pin 46 from being depressed against its spring 48. To unlock the lock, wheels 17 are dialed to the unlock combination and the shackle 19 withdrawn.

To change the combination, lock 10 is first placed in the unlock condition and shackle 19 removed. In this condition, detent pin 46, biased upwardly by spring 48, is capable of being moved downwardly against spring 48 to move the lower end of pin 46 out of the lock groove. With end cap 18 removed, wheels 17 can be translated from their position on the clutches 14 by passing wheels 17 over collar 31, leaving clutches 14 in their lock-open positions. Wheels 17 are then translated back over clutches 14 to provide any desired combination.

I claim:

1. A barrel type combination lock having an open position and a lock position including a cable and a cable shackle comprising a hollow shaft body for carrying clutches rotatable about such body;

a plurality of grooves in the cable shackle;

a plurality of well holes in the shaft body;

a plurality of steel balls positionable in the well holes and the shackle grooves to hold the cable shackle locked to the shaft body;

a recess in each clutch to accept a steel ball passing through a well hole to unlock the shackle and place the lock in its open position;

combination wheels positionable on the clutches;

cap means removably positioned on the shaft body to hold the combination wheels in place or to permit their removal for combination changes; and spring-loaded detent means holding the cap means on the shaft body, which detent means has a lower portion engaged by the cable shackle in the lock position to prevent cap removal.

2. The combination lock of claim 1 in which the clutches are held on the shaft body by a shaft body collar which carries the removable cap means.

3. In a barrel type combination lock including a plurality of clutches and removable permutation wheels and a cable having a shackle thereon, the improvement comprising a hollow shaft body having clutches rotatable about its exterior for receiving and holding the cable in locked position;

a collar portion on the body for retaining the clutches;

lock grooves on the collar portion;

a cavity in the collar portion for receiving the cable shackle;

a removable end cap carrying lock tangs for engagement with the collar lock grooves;

a recess in the interior of the cap;

a hole extending through the collar for alignment with the cap recess; and spring-loaded detent means positioned in the collar hole, such detent means having an upper portion and a lower portion whereby in the lock position the lower portion of the detent means engages the cable shackle and the upper portion is positioned in the cap recess to prevent cap removal.

* * * * *